US006435310B1

(12) United States Patent
Choi

(10) Patent No.: US 6,435,310 B1
(45) Date of Patent: Aug. 20, 2002

(54) HYDRAULIC ELEVATOR SYSTEM

(75) Inventor: Seung Chel Choi, Koyang (KR)

(73) Assignee: LG Otis Elevator Company, Seoul (KR)

( * ) Notice: Subject to any disclaimer, the term of this patent is extended or adjusted under 35 U.S.C. 154(b) by 0 days.

(21) Appl. No.: 09/459,910

(22) Filed: Dec. 14, 1999

(30) Foreign Application Priority Data

Dec. 14, 1998 (KR) ..... 98-54844

(51) Int. Cl.[7] ..... B66B 9/04

(52) U.S. Cl. ..... 187/275; 91/468; 60/466; 60/477

(58) Field of Search ..... 187/275; 60/466, 60/477; 91/468

(56) References Cited

U.S. PATENT DOCUMENTS 3,842,943 A * 10/1974 Nakamura et al. ..... 187/28
5,212,951 A * 5/1993 Fargo ..... 60/479
5,289,901 A 3/1994 Fargo

FOREIGN PATENT DOCUMENTS

JP 05147867 * 11/1991 ..... 187/275
JP 0171840 6/1994
JP 09240937 * 3/1996
JP 09240937 9/1997

* cited by examiner

*Primary Examiner*—Eileen D. Lillis
*Assistant Examiner*—Michael Lowe
(74) *Attorney, Agent, or Firm*—Birch, Stewart, Kolasch & Birch, LLP

(57) ABSTRACT

A hydraulic elevator system of an inverter control method directly controlling a flow amount of a pressed oil discharged from a hydraulic pump by a speed control of a motor driving the hydraulic pump, which can improve energy efficiency and stability. The hydraulic elevator system includes a reverse check valve connected between a hydraulic cylinder operated by the pressed oil to lift/lower an elevator car and a hydraulic pump driven to discharge the pressed oil, opened to pass the pressed oil by the pressure of the discharged pressed oil in a driving of the hydraulic pump, and closed to prevent the pressed oil from being reversed by using a pilot pressed oil of the hydraulic cylinder as a power source in a stopping of the hydraulic pump; and a pilot hydraulic cylinder operated by the pilot pressed oil from the hydraulic cylinder in order to apply an additional close force to the reverse check valve in the lifting/lowering or emergency stopping of the elevator car.

10 Claims, 7 Drawing Sheets

HYDRAULIC ELEVATOR SYSTEM

BACKGROUND OF THE INVENTION

1. Field of the Invention

The present invention relates to a hydraulic elevator system, and in particular to a hydraulic elevator system of an inverter control method directly controlling a flow amount of a pressed oil discharged from a hydraulic pump by a speed control of a motor driving the hydraulic pump, which can improve energy efficiency and stability.

2. Description of the Background Art

As widely known, a hydraulic elevator system lifts or lowers an elevator car by using a hydraulic cylinder operated by a hydraulic pump, instead of winding or releasing a rope connected to the elevator car by using a sheave rotated by a motor.

Here, the hydraulic cylinder is a single acting ram type. The elevator car is lifted by applying an oil pressure to one side portion of the ram, and lowered due to a self weight by taking back the pressed oil from the hydraulic cylinder.

The conventional hydraulic elevator system will now be described in more detail.

In the conventional hydraulic elevator system, the hydraulic pump is driven by the motor, and thus a predetermined amount of pressed oil is discharged. A flow amount control valve is employed to send the discharged pressed oil to the hydraulic cylinder.

A lifting/lowering speed of the elevator car is controlled by a bleed-off system which adjusts a flow amount of the pressed oil supplied to the hydraulic cylinder by bypassing a part of the pressed oil to an oil tank.

In order to reduce energy consumption, there has been suggested an inverter control method of performing an adjustable speed control on the motor driving the hydraulic pump in the hydraulic elevator system.

A conventional technique of the hydraulic elevator system of the inverter control method has been disclosed in the Japanese Patent Publication 5-105341. The constitution of the conventional hydraulic elevator system will now be explained with reference to FIG. 1.

FIG. 1 is a circuit diagram illustrating the conventional hydraulic elevator system.

As shown therein, reference numeral '1' denotes the hydraulic cylinder, '2' denotes the elevator car supported by the ram 1*a* of the hydraulic cylinder 1, '3' denotes the hydraulic pump reversibly rotated for pumping the pressed oil to the hydraulic cylinder 1 through a reverse check valve 5, and '4' denotes a motor for driving the hydraulic pump 3.

Here, a first valve chamber 51 which uses an oil pressure of the pressed oil pumped by the hydraulic pump 3 as a pressure source is formed at a lower portion of the reverse check valve 5.

A main chamber 52 through which the hydraulic cylinder 1 and the first valve chamber 51 of the reverse check valve 5 are connected by a second hydraulic path 6*b* discussed later is formed at a middle portion of the reverse check valve 5. A second valve chamber 53 which uses a pilot oil pressure of the hydraulic cylinder 1 as a power source is formed at an upper portion of the reverse check valve 5.

In addition, a piston-shaped valve body 54 moving to open/close the main chamber due to a pressure difference between the first valve chamber 51 and the second valve chamber 53 is inserted into the reverse check valve 5. A stopper 56 restricting a lifting operation of the valve body 54 and an adjusting screw 57 externally adjusting a stroke of the stopper 56 are disposed at an upper end portion of the reverse check valve 5.

In regard to the constitution of the conventional hydraulic circuit, there are provided a hydraulic circuit 6 including a first hydraulic path 6*a* connecting the hydraulic pump 3 to the first valve chamber 51 of the reverse check valve 5, and a second hydraulic path 6*b* connecting the main chamber 52 of the reverse check valve 5 to the hydraulic cylinder 1; and a pilot circuit 9 branched from the second hydraulic path 6*b* of the hydraulic circuit 6, and including a pilot pressed oil inlet pipe 9*a* connecting the reverse check valve 5 to the second valve chamber 53, and a pilot pressed oil discharge pipe 9*b* connecting the second valve chamber 53 to the oil tank 8.

In addition, a normal open type solenoid valve 10 is disposed at the inlet pipe 9*a* of the pilot circuit 9, and a normal close type solenoid valve 11 is disposed at the discharge pipe 9*b*.

Variable throttle valves 12, 13 for controlling a flow amount of the pressed oil passing through the inlet pipe 9*a* and the discharge pipe 9*b* are provided to an entrance side of the inlet pipe 9*a* of the pilot circuit 9 and an exit side of the discharge pipe 9*b* thereof, respectively.

A control unit 14 for controlling the motor 4 and the solenoid valves 10, 11 is provided in order to control the lifting, lowering and stopping operations and the speed of the elevator car 2 by the operation of the user.

The operation of the conventional hydraulic elevator system having the hydraulic circuit will now be described.

Firstly, when a lifting operation command of the elevator car 2 is outputted from the control unit 14, at the same time, a solenoid coil (not shown) of the normal open type and closed solenoid valves 10, 11 is magnetically excited responding to a control signal from the control unit 14, and a rotor of the motor 4 rotates.

The oil pressure of the pressed oil pumped by the hydraulic pump 3 driven by the motor 4 is applied to the reverse check valve 5, the normal open type solenoid valve 10 is closed, and the normal close type solenoid valve 11 is opened. Accordingly, a pressure of the first valve chamber 51 is relatively higher than that of the second valve chamber 53, the valve body 54 is lifted, and thus the first valve chamber 51 is opened to the main chamber 52.

Therefore, the pressed oil discharged from the hydraulic pump 3 is supplied to the hydraulic cylinder 1 through the first valve chamber 51 and the main chamber 52 of the reverse check valve 5, and the car 2 is lifted at a speed corresponding to a flow amount of the pressed oil.

During the lifting operation of the elevator car 2, when it reaches to a destination floor, an excitation current of the solenoid valves 10, 11 is shut up by a signal from the control unit 14, the normal open and close type solenoid valves 10, 11 return to the original open and close states, respectively, and the driving of the motor 4 stops.

Then, the pressed oil is supplied to the second valve chamber 53 of the reverse check valve 5 through the variable throttle valve 12 disposed at the inlet pipe 9*a* of the pilot circuit 9, the valve body 54 of the reverse check valve 5 is lowered according to a flow amount of the pressed oil supplied into the second valve chamber 53, and thus an opening of the main chamber 51 is gradually decreased. Accordingly, the lifting speed of the elevator car 2 is gradually reduced.

When the valve body 54 is lowered and the main chamber 52 of the reverse check valve 5 is completely closed, the elevator car 2 stops at the designated floor.

On the other hand, conversely, when a lowering operation command of the elevator car 2 is outputted from the control unit 14, at the same time, according to the control signal from the control unit 14, the normal open type solenoid valve 10 is closed, the normal close type solenoid valve 11 is opened, and the motor 4 is temporarily rotated.

The hydraulic pump 3 is temporarily driven by the temporary rotation of the motor 4. A pressure of the first valve chamber 51 of the reverse check valve 5 becomes higher than that of the second valve chamber 53 thereof by the pressed oil pumped by the driving of the hydraulic pump 3. Accordingly, the valve body 54 is lifted, and thus the main chamber 52 of the reverse check valve 5 is opened, as in the lifting operation of the elevator car 2.

When the main chamber 52 of the reverse check valve 5 is opened, the driving of the motor 4 stops, and the pressed oil in the hydraulic cylinder 2 is reversed through the main chamber 52 and the first valve chamber 51 of the reverse check valve 5, and discharged to the oil tank 8, rotating the hydraulic pump 3 in a reverse direction. Accordingly, the lowering operation of the elevator car 2 is performed by its own weight.

Here, the elevator car 2 is lowered at a speed according to an opening of the main chamber 52 of the reverse check valve 5. When the main chamber 52 is completely opened, the elevator car 2 is lowered at a maximum speed.

During the lowering operation of the elevator car 2, the hydraulic pump 3 is operated as the hydraulic motor by the reversed pressed oil, and the motor 4 directly connected to the hydraulic pump 3 is operated in a regenerative braking state, thereby restricting a flow amount of the pressed oil reversed from the hydraulic cylinder 1 to the oil tank 8. As a result, the elevator car 2 can be lowered at a stable speed.

At the lowering operation of the elevator car 2, when the elevator car 2 reaches to the destination floor, identically to the stopping of the lifting operation, the excitation current of the solenoid valves 10, 11 is intercepted by the signal from the control unit 14, the normal open type solenoid valve 10 is opened, and the normal close type solenoid valve 11 is closed.

Then, the pressed oil is supplied to the second valve chamber 53 of the reverse check valve 5 through the variable throttle valve 12 disposed at the pilot inlet pipe 9*a,* the valve body 54 of the reverse check valve 5 is lowered according to the flow amount of the pressed oil supplied to the second valve chamber 53, the opening of the main chamber 52 is gradually decreased, and thus the lowering speed of the elevator car 2 is gradually reduced.

When the main chamber 52 of the reverse check valve 5 is completely closed by the lowering valve body 54, the elevator car 2 stops at the destination floor.

However, during the lowering operation of the elevator car 2, in case the power supply supplied to the motor 4 is broken due to the power failure, etc., the motor 4 cannot perform the regenerative braking operation, thus sharply increasing the flow amount of the pressed oil reversed to the oil pump 3 through the reverse check valve 5.

As a result, the lowering speed of the elevator car 2 is considerably increased. Accordingly, the valve body 54 is restricted to lift by the stopper 56 formed at the upper end portion of the reverse check valve 5 and the adjusting screw 57 adjusting the stopper 56, thereby preventing the flow amount of the pressed oil from being sharply increased.

That is, the valve body 54 is lifted below a predetermined value by the stopper 56 adjusted by the adjusting screw 57, and thus the opening of the main chamber 52 is limited. Therefore, in the lowering operation of the elevator car 2, the flow amount of the pressed oil reversed during the power failure is restricted below a predetermined value, and thus the lowering speed of the elevator car 2 is also restricted.

Conversely, when the elevator car 2 is lifted, the opening of the reverse check valve 5 is restricted by the stopper 56. Accordingly, when the pressed oil passes through the reverse check valve 5, a pressure loss is increased.

In order to compensate for the pressure loss, the motor must be designed to have a capacity over an adequate level. In addition, a pressed oil temperature of the hydraulic circuit is increased due to the pressure loss. In order to cool it, a capacity of a special oil cooler must be increased.

That is, to control the flow amount of the pressed oil by restricting the lifting of the valve body 54 with the stopper decreases efficiency of the whole operation, and increases an equipment cost and an energy consumption.

On the other hand, in order to improve the close operation of the reverse check valve 5, an oil pressure applying area of the second valve chamber 53 of the valve body 54 is set larger than that of the first valve chamber 51 thereof. However, the reverse check valve 5 is always closed due to an area difference even when the two valve chambers 51, 53 have an identical pressure.

However, in the lifting operation of the elevator car 2, when the normal open type solenoid valve 10 and the normal close type solenoid valve 11 are on, the pressed oil of the hydraulic pump 3 can flow to the hydraulic cylinder 1. Here, the pressure loss is unnecessarily generated due to the difference in the oil pressure applying area of the valve body 54. In addition, an shock is generated due to a pressure unbalance, thereby causing an energy loss.

Accordingly, in order to overcome such disadvantages, the reverse check valve 5 must be completely opened during the lifting operation of the elevator car 2. As a result, in case the power failure takes place, a returning time of the reverse check valve 5 becomes longer. In a worst case, the elevator car may fall to the ground.

SUMMARY OF THE INVENTION

It is therefore a primary object of the present invention to provide a hydraulic elevator system which can prevent a reverse check valve from being opened due to a small pressure difference, when the reverse check valve must be closed, and which can minimize an shock on an elevator car at the time of starting.

It is another object of the present invention to provide a hydraulic elevator system which can prevent energy waste by minimizing a pressure loss generated when a pressed oil passes through a reverse check valve during a lifting/lowering operation of an elevator car.

It is still another object of the present invention to provide a hydraulic elevator system which can prevent an overspeed of an elevator car by increasing an initial close speed of a reverse check valve, when an emergency stopping of the elevator car is necessary during the operation due to the power failure, etc., and which can minimize an shock on an elevator car to be generated by the stopping of the elevator car during the deceleration for the later stopping thereof.

In order to achieve the primary object of the present invention, there is provided a hydraulic elevator system including an elevator car vertically movable in a hoist way of a building; a hydraulic cylinder connected to the elevator car for lifting/lowering the elevator car; a hydraulic pump for supplying a pressed oil to the hydraulic cylinder; a motor for driving the hydraulic pump; a reverse check valve disposed at an oil path between the hydraulic cylinder and the hydraulic path opened to allow the pressed oil to be supplied from the hydraulic pump to the hydraulic cylinder when the elevator car is lifted, closed by a pilot pressed oil from the hydraulic cylinder to prevent an oil back current from the hydraulic cylinder to the hydraulic pump when the elevator car stops, and opened by the pressed oil from the hydraulic pump when the elevator car is lowered, in order to allow the elevator car to be lowered; and a pilot hydraulic cylinder unit disposed at an oil path between the hydraulic cylinder and the reverse check valve for applying an additional force to the reverse check valve in a close direction by the pilot pressed oil from the hydraulic pump.

In order to achieve another object of the present invention, there is provided a hydraulic elevator system wherein a horizontal cross-sectional area of the plot hydraulic cylinder unit is basically smaller than that of the reverse check valve in order to minimize an oil pressure loss during the lifting/lowering operation of the elevator car.

In order to achieve still another object of the present invention, there is provided a hydraulic elevator system including:

A valve chamber for supplying a pilot pressed oil supply path from the hydraulic cylinder connected to the elevator car to the reverse check valve in order to rapidly close the reverse check valve at an initial stage of the emergency stopping of the elevator car; a pilot hydraulic cylinder having a piston body provided with a ring-shaped groove at its upper diameter portion in order to supply the pilot supply path to the reverse check valve with the valve chamber; and a throttle valve for slowly supplying the pilot pressed oil to the reverse check valve little by little during the deceleration of the elevator car for the emergency stopping.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

A hydraulic elevator system in accordance with the present invention will now be described with reference to the accompanying drawings.

Figure 1:
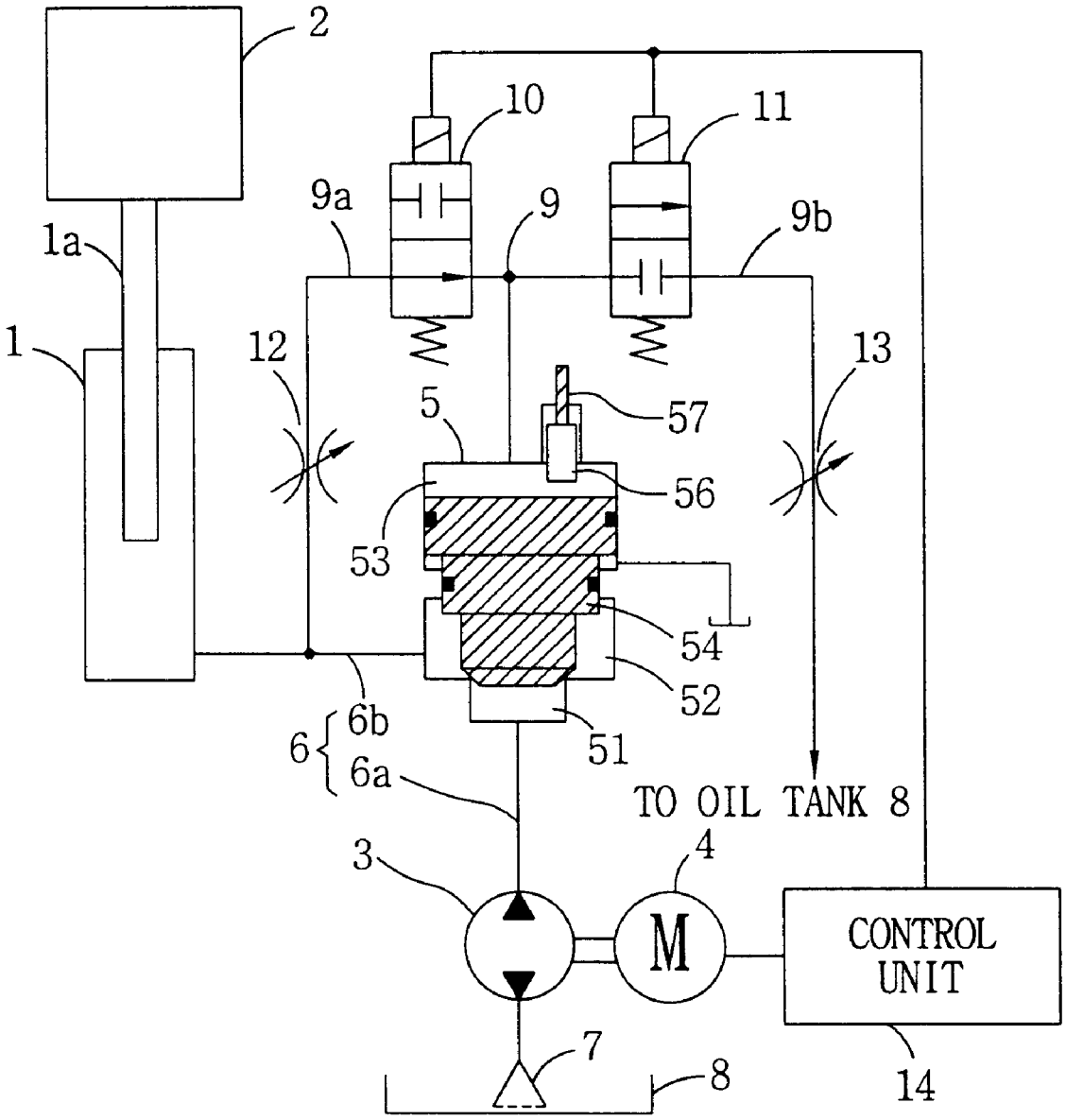
FIG. 1 BACKGROUND ART
FIG. 1 is a hydraulic circuit diagram illustrating a conventional hydraulic elevator system.
Figure 2:
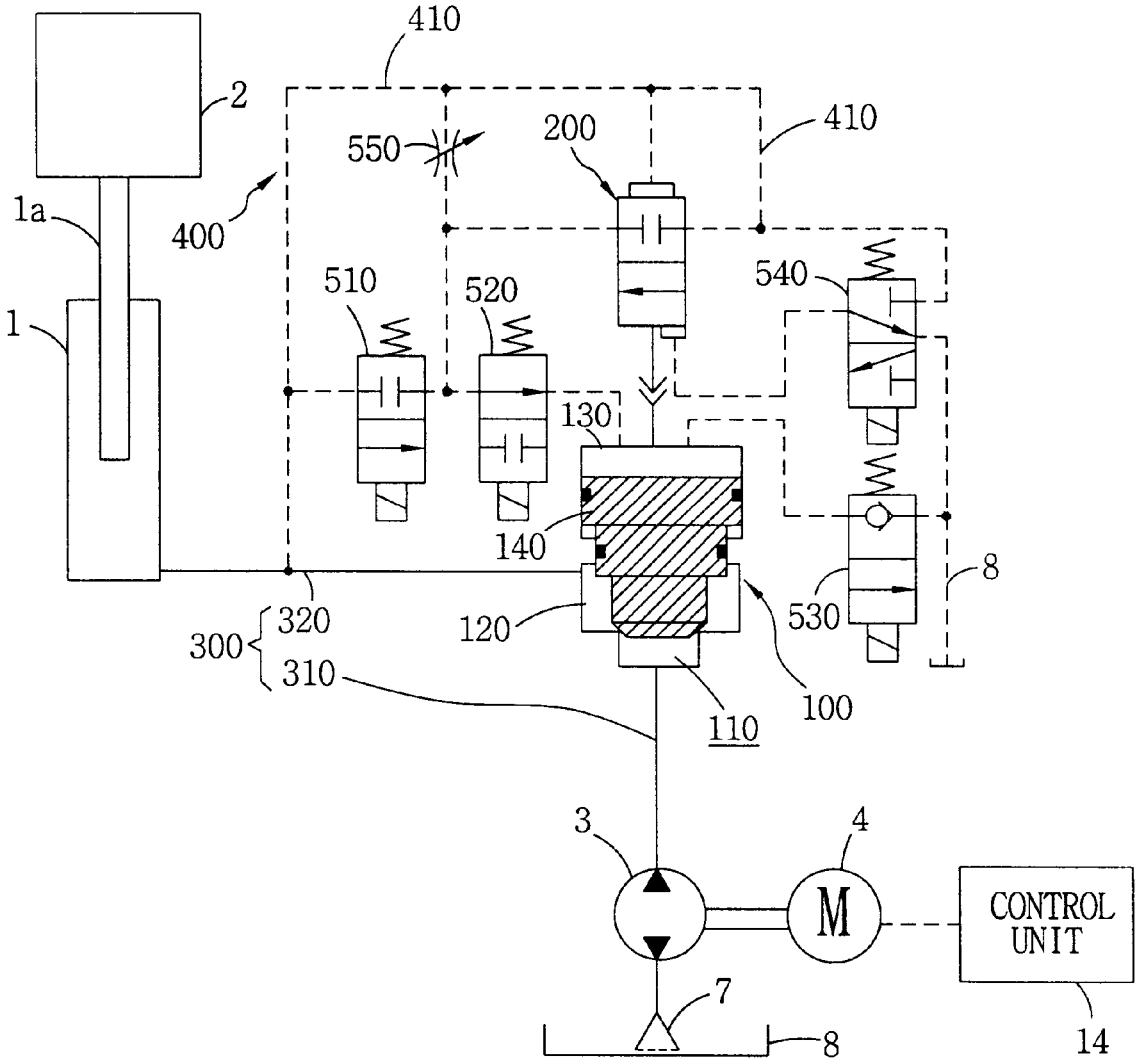
FIG. 2 is a hydraulic circuit diagram illustrating a hydraulic elevator system in accordance with the present invention.

FIG. 2 is a hydraulic circuit diagram illustrating the hydraulic elevator system in accordance with the present invention. The constitutional elements identical to the conventional art are provided with the same reference numerals.

In the hydraulic elevator system according to the present invention, an elevator car 2 is a cage which is vertically movable in a hoist way in order to provide a service of loading passengers or cargo at a hall of each floor of a building, and transferring them to a destination floor.

Reference numeral '1' denotes a hydraulic cylinder operated by a pressed oil for providing a driving force moving the elevator car 2 in a vertical direction.

One end portion of a single acting ram 1*a* which is a kind of piston rod is connected to the car 2, and the other end portion thereof is supported in the hydraulic cylinder 1 to be moved forward or retreated.

Reference numeral '3' denotes a hydraulic pump for pumping the pressed oil which is a driving source moving the elevator car 2, and '4' denotes a motor for driving the hydraulic pump 3, preferably an AC induction motor.

In addition, reference numeral '7' denotes an oil filter for filtering the oil supplied from an oil tank 8 to the hydraulic pump 3, or the oil retrieved from the hydraulic pump 3 or the other devices, and '8' denotes the oil tank for storing the oil supplied to the hydraulic pump 3, or the oil retrieved from the hydraulic pump 3 or the other devices.

Figure 4:
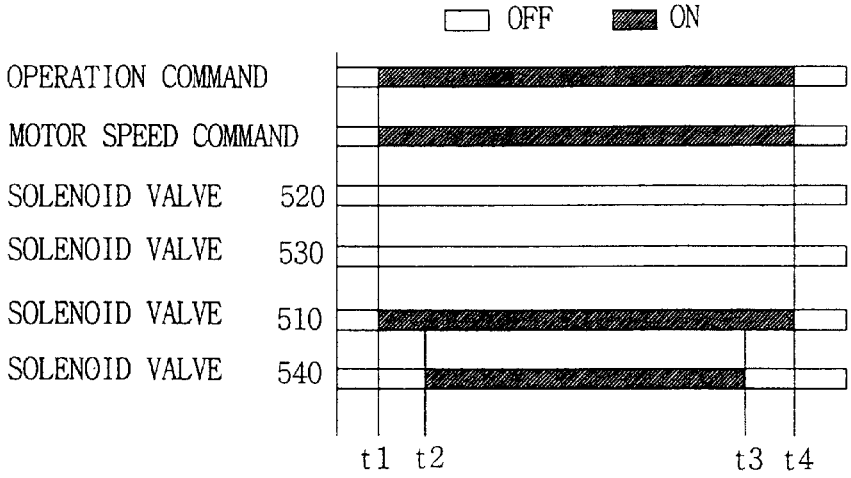
FIG. 4 is a time chart of control signals outputted from a control unit of the hydraulic elevator system in accordance with the present invention, during the lifting operation.
Figure 6:
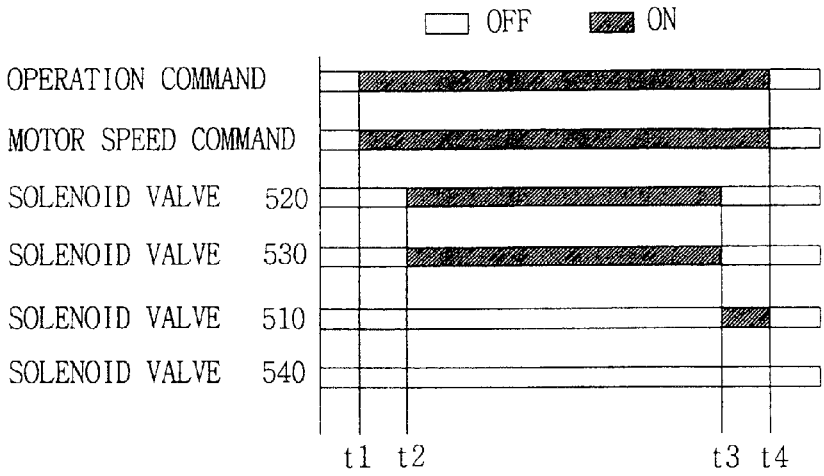
FIG. 6 is a time chart of the control signals outputted from the control unit of the hydraulic elevator system in accordance with the present invention, during the lowering operation.
Figure 8:
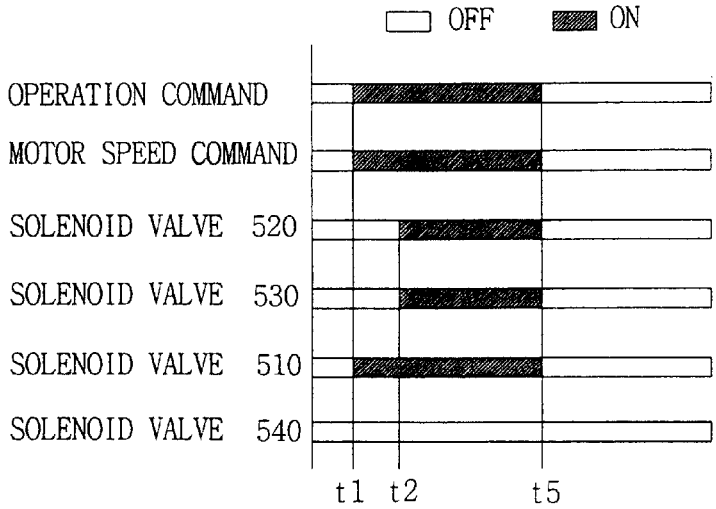
FIG. 8 is a time chart of the control signals outputted from the control unit of the hydraulic elevator system in accordance with the present invention, during the emergency stopping operation.

Reference numeral '14' denotes a controller for outputting an operation command and a speed command to the motor, and control signals, namely an ON or OFF command signal to various solenoid valves discussed later, as shown in FIGS. 4, 6 and 8, according to a memorized program in order to service the elevator car 2 to a corresponding floor by responding to a car call button (not shown) disposed at each floor hall and a designated floor selection button (not shown) disposed in the car 2.

In addition, when opened by the pressed oil pumped in the hydraulic pump 3, a reverse check valve 100 connected to an oil path between the hydraulic cylinder 1 and the hydraulic pump 3 allows the pressed oil to be supplied to the hydraulic cylinder 1. When the hydraulic pump 3 stops, the reverse check valve 100 is closed by the pilot pressed oil from the hydraulic cylinder 1, and accordingly prevents the pressed oil from being reversed from the hydraulic cylinder 1 to the hydraulic pump 3.

The reverse check valve 100 includes: a first valve chamber 110 connected with a first main oil path 310 connected to the hydraulic pump 3; a second valve chamber 120 connected with a second main oil path 320 connected to the hydraulic cylinder 1; a third valve chamber 130 connected to a pilot hydraulic cylinder 200 discussed later in detail; and a valve body 140 displaceable to a position of allowing or blocking a flow of the pressed oil between the first valve chamber 110 and the second valve chamber 120.

Here, the first main oil path 310 and the second main oil path 320 serve to enable the pressed oil to flow through the hydraulic cylinder 1, the hydraulic pump 3 and the reverse check valve 100. The first main oil path 310 connects the hydraulic pump 3 with the reverse check valve 100, and the second main oil path 320 connects the reverse check valve 100 with the hydraulic cylinder 1, thus constituting a pressed oil circuit 300.

In addition, a pilot hydraulic cylinder 200 is engaged with the reverse check valve 100, and thus provides an additional force onto the reverse check valve 100 in a close direction.

On the other hand, there is provided a pilot circuit 400 which is a hydraulic circuit including an oil path connected to supply the pilot pressed oil from the hydraulic cylinder to the reverse check valve 100 and the pilot hydraulic cylinder 200, and an oil path of the oil discharged from the reverse check valve 100 and the pilot hydraulic cylinder 200.

A normal close-type solenoid valve 510 is disposed at the oil path in the pilot circuit 400 connected from the hydraulic cylinder 200 to the reverse check valve 100, and allows or blocks the flowing of the pressed oil supplied from the hydraulic cylinder 1 to the reverse check valve 100. The normal close-type solenoid valve 510 is operated according to the ON or OFF control signal from the control unit 14.

The normal open-type solenoid valve 520 is disposed at the oil path of the pilot circuit 400 between the normal close-type solenoid valve 510 and the reverse check valve 100. The oil path from the normal close-type solenoid valve 510 to the normal open-type solenoid valve 520 is connected to an outlet path from a throttle valve 550 and an outlet path from the pilot hydraulic cylinder 200.

Here, the normal open-type solenoid valve 520 supplies or blocks the pilot pressed oil from the normal close-type solenoid valve 510 and/or the pilot pressed oil from the throttle valve 550 and the pilot pressed oil from the pilot cylinder 200 to/from the reverse check valve 100 according to the ON or OFF control signal from the control unit 14.

A solenoid valve 530 is provided at the oil path from the third valve chamber 130 of the reverse check valve 100 to the oil tank 8, and allows/blocks a discharge of the pressed oil from the third valve chamber 130 to the oil tank 8 according to the control signals from the control unit 14.

A three way solenoid valve 540 is connected to the oil path among the pilot pressed oil circuit 400, the pilot hydraulic cylinder 200 and the oil tank 8 for connecting or blocking the pilot hydraulic cylinder 200, the hydraulic cylinder 1 and the oil tank 8 one another. The three way solenoid valve 540 changes an oil path direction to a direction of supplying the pilot pressed oil from the pilot pressed oil circuit 400 to the pilot hydraulic cylinder 200, a direction of discharging the pressed oil from the pilot hydraulic cylinder 200 to the oil tank 8, and a direction of blocking an oil path connection among the pilot pressed oil circuit 400, the pilot hydraulic cylinder 200 and the oil tank 8, according to the control signals from the control unit 14.

The throttle valve 550 is disposed at the oil path in the pilot pressed oil circuit 400 connecting the hydraulic cylinder 1 and the solenoid valve 520.

That is, an inlet of the throttle valve 550 is connected to the pilot oil path of the hydraulic cylinder 1, and an outlet thereof is connected to an inlet of the solenoid valve 520 through the oil path.

During the deceleration of the elevator car 2 for the emergency stopping operation, the throttle valve 550 serves to slowly provide the pilot pressed oil from the hydraulic cylinder 1 to the third valve chamber 130 of the reverse check valve 100 via the solenoid valve 520 little by little, thereby slowly moving a valve body 140 of the reverse check valve 100 in the close direction.

The reverse check valve 100, the pilot cylinder 200 and the other valves, and the hydraulic circuit connection thereof will now be described in more detail with reference to FIG. 3.

Figure 3:
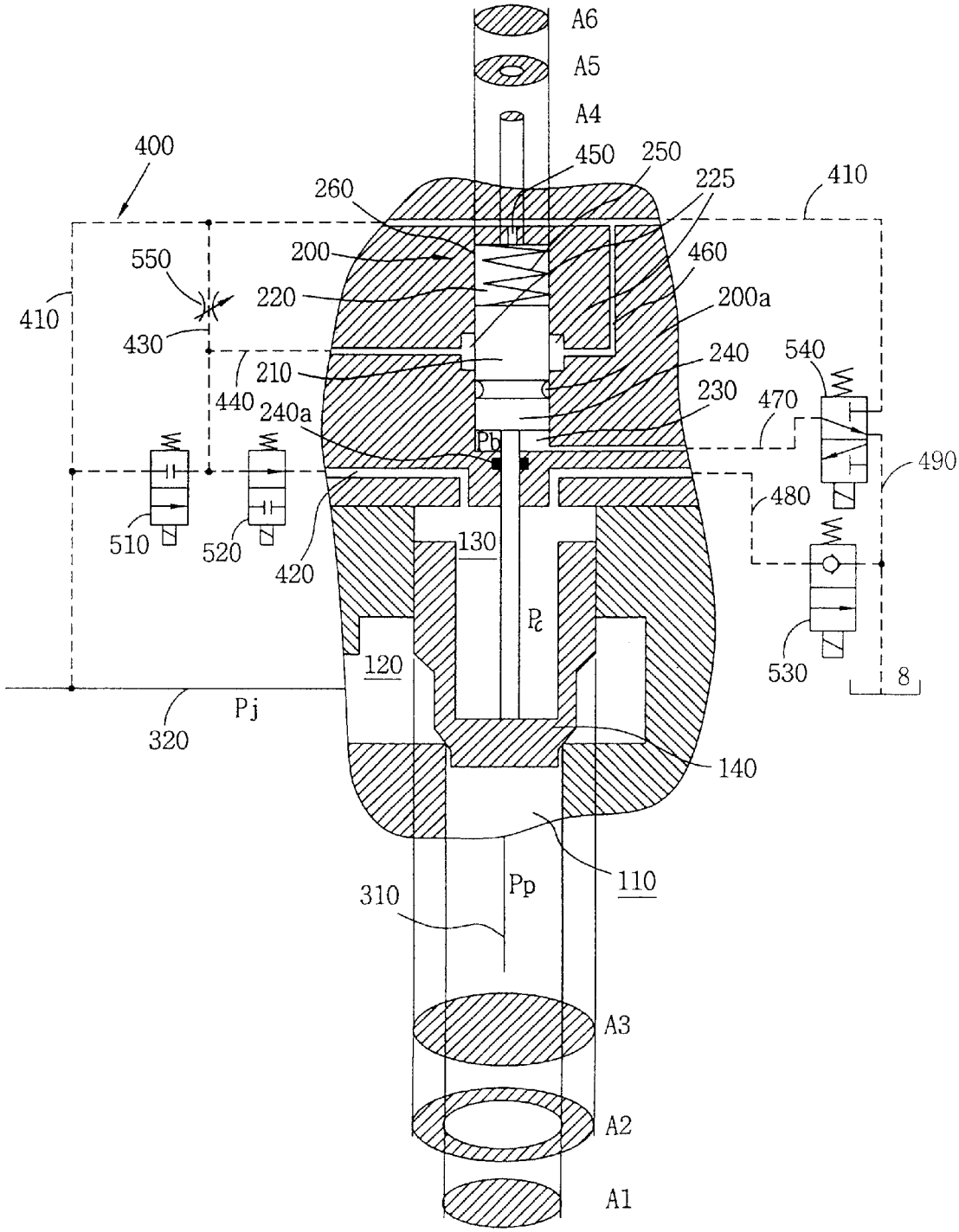
FIG. 3 is a detailed hydraulic circuit diagram illustrating the hydraulic elevator system in accordance with the present invention, during the stopping operation, wherein essential components of a reverse check valve and a pilot hydraulic cylinder are compared.

FIG. 3 is a detailed hydraulic diagram illustrating the hydraulic elevator system in accordance with the present invention, during the stopping operation, wherein essential components of the reverse check valve and the pilot hydraulic cylinder are compared.

As shown therein, the reverse check valve 100 includes: the first valve chamber 110 connected to the first main oil path 310 from the hydraulic pump 3 at a lower portion thereof; the third valve chamber 130 connected to the pilot oil path 400 of the hydraulic cylinder 1 at an upper portion thereof; and the second valve chamber 120 engaged with one side of the hydraulic cylinder 1 between the first valve chamber 110 and the third valve chamber 130.

The valve body 140 is movable to a position of allowing an oil flow between the second valve chamber 120 and the first valve chamber 110, namely an open position, and to a position of blocking the oil flow therebetween, namely a close position, due to a pressure difference between the first valve chamber 110 and the third valve chamber 130 is provided in the valve chamber consisting of the first valve chamber 110, and third valve chamber 130 and the second valve chamber 120.

In order to receive a pressure in an opening direction of the valve by the pressed oil from the hydraulic cylinder 1, a step is formed at an outer diameter portion of the valve body 140 toward the second valve chamber 120.

On the other hand, the pilot hydraulic cylinder 200 engaged with the reverse check valve 100 includes: a piston body 210 movable to an open/close direction of the reverse check valve 100 by the pilot pressed oil from the hydraulic cylinder 1; a piston rod 240 having one end portion engaged with the valve body 140 of the reverse check valve 100, having the other end portion engaged with the piston body 210 for transmitting displacement of the piston body 210 in the close direction of the reverse check valve 100 to the reverse check valve 100; a spring 250 abutting to the piston body 210 for biasing the piston body 210 in the close direction of the reverse check valve 100; and a cylinder 260 for receiving the spring 250, the piston rod 240 and the piston body 210 therein.

Here, the cylinder 260 includes: an upper chamber 220 formed of surfaces of the piston body 210 abutting to the spring 250 and inner walls of the cylinder 260 for receiving the pilot pressed oil; and a lower chamber 230 formed of surfaces of the piston body 210 engaged with the piston rod 240 and the inner walls of the cylinder 260 for receiving the pilot pressed oil. In case the reverse check valve 100 is opened, the cylinder 260 further includes a middle chamber 225 formed of a ring-shaped groove 200*a* of the piston body 210 and inner walls of the cylinder 260.

Here, the vertical position of the ring-shaped groove 200*a* of the piston body 210 is preferably formed at a position where it can be connected with the two middle chambers 225 of the cylinder 260 connected to a fourth pilot oil path 440 and a sixth pilot oil path 460 of the pilot oil path 400 discussed later, in a state where the piston body 210 is maximally upwardly moved, that is the reverse check valve 100 is completely opened.

An O-ring 240*a* is fixed to the piston rod 240, thereby preventing leakage of the pressed oil.

On the other hand, the pilot circuit 400 includes: a first pilot oil path 410 connected to a second main oil path 320 of a main circuit 300, and connected to supply the pilot pressed oil from the hydraulic cylinder 1 to the normal close-type solenoid valve 510, the throttle valve 550, the upper chamber 220 of the pilot hydraulic cylinder 200 and the three way solenoid valve 540; a second pilot oil path 420 connected between the solenoid valve 520 and the third valve chamber 130 of the reverse check valve 100 for supplying the pilot pressed oil from the normal open-type solenoid valve 520 to the third valve chamber 130 of the reverse check valve 100; a third pilot oil path 430 branched off from the first pilot oil path 410, and connected to the oil path between the solenoid valve 510 and the solenoid valve 520 through the throttle valve 550; a fourth pilot oil path 440 connected between the middle chamber 225 of the pilot hydraulic cylinder 200 and the third pilot oil path 430, for supplying the pilot pressed oil from the hydraulic cylinder 1 to the third valve chamber 130 of the reverse check valve 100 in order to perform the emergency stopping operation of the elevator car in a state where the reverse check valve 100 is opened; a fifth pilot oil path 450 branched off from the first pilot oil path 410, and connected to the upper chamber 220 of the pilot hydraulic cylinder 200, for supplying the pilot pressed oil from the hydraulic cylinder 1 so as to move the piston body 210 in a downward direction (close direction of the reverse check valve 100); a sixth pilot oil path 460 branched off from the first oil path 410, and connected to middle chamber 225 of the pilot hydraulic cylinder 200, for supplying the pilot pressed oil from the hydraulic cylinder 1 to the middle chamber 225; a seventh pilot oil path 470 for providing an oil path in order to supply the pilot pressed oil from the hydraulic cylinder 1 to the lower chamber 230, or discharge the pilot pressed oil from the lower chamber 230 to the three way solenoid valve 540; an eighth pilot oil path 480 connected between the third valve chamber 130 of the reverse check valve 100 and the solenoid valve 530, for providing an oil path in order to discharge the pilot pressed oil from the third valve chamber 130 to the solenoid valve 530; and a ninth pilot pressed oil 490 connected between the three way solenoid valve 540 and the oil tank 8, for providing an oil path in order to discharge the pilot pressed oil from the three way solenoid valve 540.

In addition, in FIG. 3, reference numeral 'A1' denotes an applying area of the oil pressure of the pressed oil applied to the valve body 140 of the first valve chamber 110 of the reverse check valve 100 in the open direction (upward direction) of the valve, and a horizontal cross-section of the first valve chamber 110. Reference numeral 'A2' denotes an applying area of the oil pressure of the pressed oil applied to the valve body 140 of the second valve chamber 120 of the reverse check valve 100 in the open direction (upward direction) of the valve. Reference numeral 'A3' denotes an applying area of the oil pressure of the pressed oil applied to the valve body 140 of the third valve chamber 130 of the reverse check valve 100 in the close direction (downward direction) of the valve, and a horizontal cross-section of the third valve chamber 130.

Reference numeral 'A4' denotes an applying area of the oil pressure of the pressed oil applied from the hydraulic cylinder 1 to the piston rod 240 in the third valve chamber 130 in the upward direction (open direction of the reverse check valve 100). Reference numeral 'A5' denotes an applying area of the oil pressure of the pressed oil applied from the hydraulic cylinder 1 to the piston body 210 in the lower chamber 230 of the pilot hydraulic cylinder 200 in the upward direction (open direction of the reverse check valve 100). Reference numeral 'A6' denotes an applying area of the oil pressure of the pressed oil applied from the hydraulic cylinder 1 to the piston body 210 in the upper chamber 220 of the pilot hydraulic cylinder 200 in the lower direction (close direction of the reverse check valve 100).

In addition, reference numerals Pj, Pp, Pc and Pb denote a pressure of the hydraulic cylinder, a pressure of the hydraulic pump, a pressure of the second valve chamber 120 and a pressure of the lower chamber 230.

The operation of the hydraulic elevator system in accordance with the present invention will now be described in each operational state of the elevator car.

When the elevator car 2 is stopped, as shown in FIG. 3, the solenoid valves 510, 520, 530, 540 are OFF, responding to the control signals from the control unit 14.

At the same time, the control unit 14 outputs an operation command signal, a speed command signal, a stop command signal and an acceleration command signal to the motor 4 and the hydraulic pump 3, and thus the pressure Pp from the hydraulic pump 2 is '0'.

Figure 5:
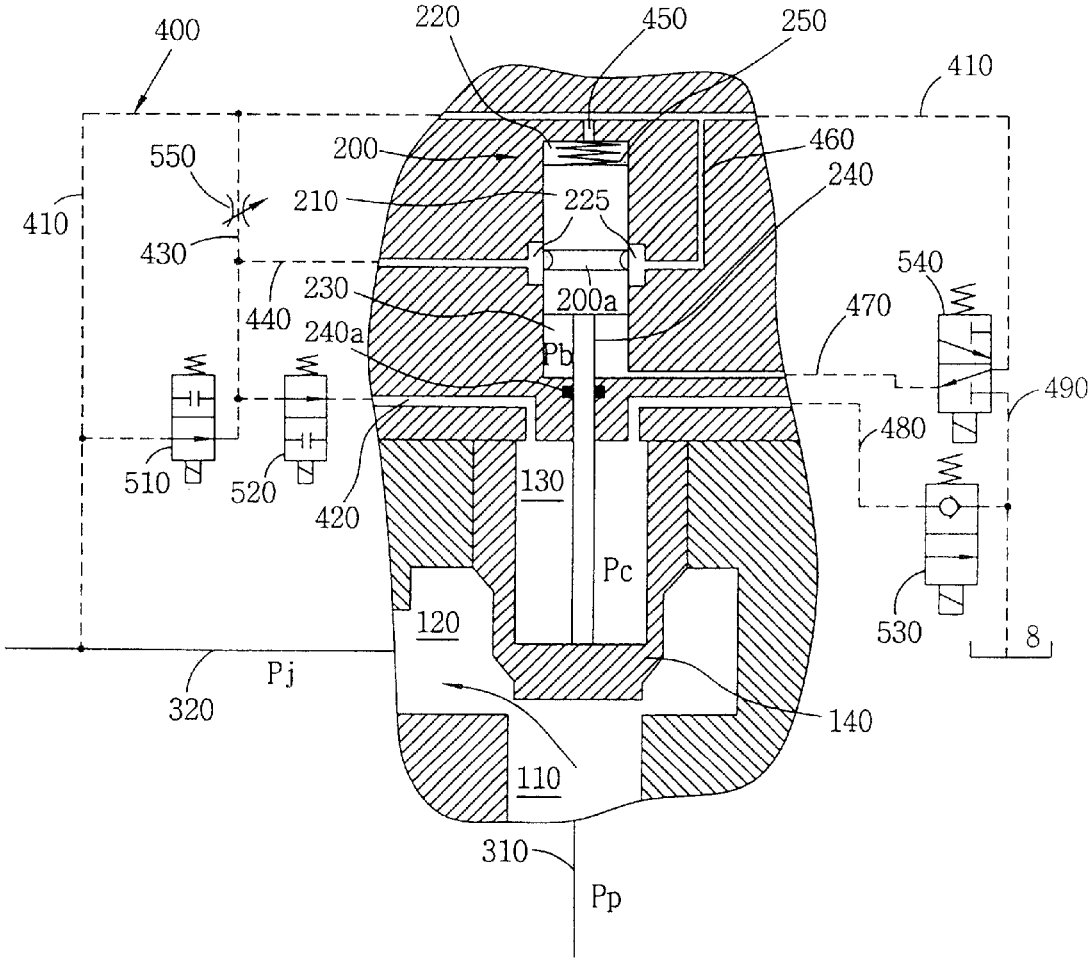
FIG. 5 is a detailed hydraulic circuit diagram illustrating the hydraulic elevator system in accordance with the present invention, during the lifting operation.
Figure 7:
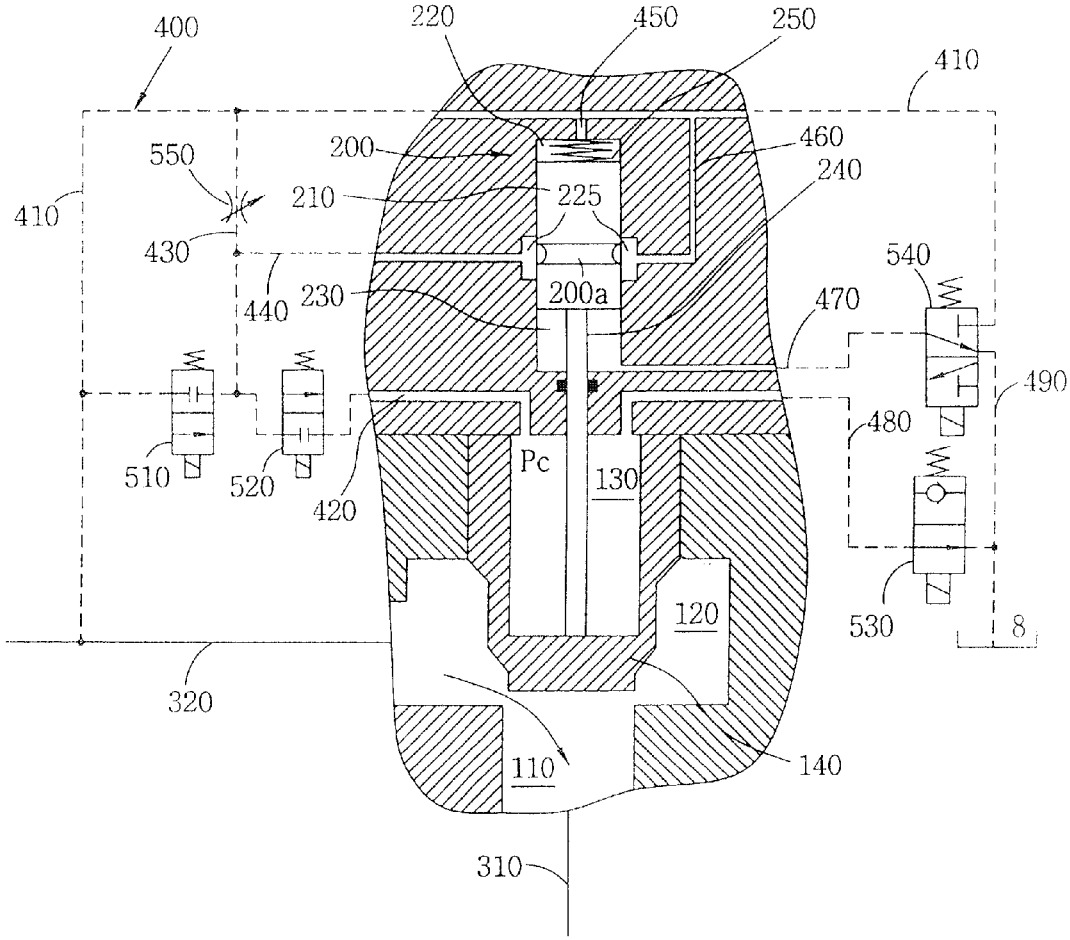
FIG. 7 is a detailed circuit hydraulic diagram illustrating the hydraulic elevator system in accordance with the present invention, during the lowering operation.

Here, as illustrated in FIGS. 5 and 7, while the elevator car 2 is lifted or lowered, the pilot oil path from the hydraulic cylinder 1 is opened, and thus the pilot pressed oil is filled in the third valve chamber 130 of the reverse check valve 100.

In addition, the pilot pressed oil from the hydraulic cylinder 1 is supplied to the upper chamber 220 of the pilot hydraulic cylinder 200 via the first pilot oil path 410 and the fifth pilot oil path 450, and the pilot pressed oil in the lower chamber 230 is discharged to the oil tank 8 via the three way solenoid valve 540 and the ninth pilot oil path 490.

On the other hand, the pressure Pc in the third valve chamber 130 is applied to the piston rod 240 in the vertical direction in regard to the applying area A4. However, the pressure Pc is equal to the pressure Pj from the hydraulic cylinder 1, and the applying area A4 is much greater than the applying area A6, and thus the piston body 210 and the piston rod 240 of the pilot hydraulic cylinder 200 move to the direction of closing the reverse check valve 100.

At this time, the pressure Pj applied from the hydraulic cylinder 1 to the valve body 140 in the open direction is equal to the pressure Pc applied to the valve body 140 in the close direction by the pressed oil in the third valve chamber 130, the applying area A3 is greater than the applying area A2, and thus the reverse check valve 100 is closed.

In addition, an additional pressure is applied to the reverse check valve 100 in the close direction by the piston rod 240 of the pilot hydraulic cylinder 200, and the spring 250 always applies an elastic force to the piston body 210 and the piston rod 240 of the pilot hydraulic cylinder 200 in the downward direction, namely the close direction of the reverse check valve 100.

The operation of the hydraulic elevator system in accordance with the present invention is represented by the following expression.

Here, when it is presumed that the direction of closing the valve body 140 is a positive (+) direction and the direction of opening the valve body 140 is a negative (−) direction, a force F applied to the valve body 140 is represented by Expression 1.

$$F=-(A1)(Pj)-(A2)(Pj)+(A3)(Pc)-(A4)(Pc)-(A5)(Pj)+(A6)(Pj)+Fs \quad \text{[Expression 1]}$$

Here, Fs indicates an elastic restoring force applied to the piston body 210 of the pilot hydraulic cylinder 200 in the positive direction.

Each applying area is represented by Expression 2.

$$(A1)+(A2)=(A3),\ (A4)+(A5)=(A6) \quad \text{[Expression 2]}$$

In this state, when the car 2 is stopped, it is satisfied that Pp=Pb=0 and Pc=Pj. Accordingly, if this condition is introduced to Expression 1, the force F applied to the valve body 140 when the car 2 is stopped is defined as follows.

$$F=\{(A3-A2)(Pj)+(A6-A4)(Pj)+Fs)\}>0 \quad \text{[Expression 3]}$$

That is, as shown in Expression 3, when the car 2 is stopped, the force F applied to the valve body 140 of the reverse check valve 100 is applied in the positive direction, and accordingly the reverse check valve 100 does not move in the negative direction, thereby preventing the pressed oil from being reversed. As a result, the elevator car 2 is stably stopped.

On the other hand, the lifting operation of the elevator car 2 in the stopping state will now be explained with reference to FIGS. 4 and 5.

FIG. 4 is a time chart of the control signals outputted from the control unit of the hydraulic elevator system in accordance with the present invention, during the lifting operation, and FIG. 5 is a detailed circuit diagram illustrating the hydraulic elevator system in accordance with the present invention, during the lifting operation.

When the control unit 14 outputs the lifting operation command signal of the elevator car 2, and simultaneously outputs the speed command signal to the motor 4, as shown in FIG. 4, the motor 4 is driven at a starting point t1 of the lifting operation, and the hydraulic pump 3 directly connected to the motor 4 is driven. Accordingly, the pressed oil is discharged, and supplied to the first valve chamber 110 of the reverse check valve 100.

Here, when it is presumed that the pilot hydraulic cylinder 200 does not exist, the force F applied to the valve body 140 is represented by Expression 4.

$$F=-(A1)(Pp)-(A2)(Pj)+(A3)(Pc)+Fs \quad \text{[Expression 4]}$$

In the case that the pressure Pj is equal to the pressure Pc, and the pressure Pp of the hydraulic pump 3 is greater than the pressure Pc of the third valve chamber 130, Expression 4 is modified to Expression 5.

$$F=-(A1)(Pp)-(A2)(Pj)+(A3)(Pc)+Fs=-(A1)(Pp)-(A2)(Pj)+(A1+A2)(Pc)+Fs=(A1)(Pc-Pp)+Fs=(A1)(Pj-Pp)+Fs \quad \text{[Expression 5]}$$

Accordingly, when the pressure Pp from the hydraulic pump 3 is greater than the pressure Pc in the third valve chamber 130 of the reverse check valve 100, and thus the force in the negative direction by the pressure difference is greater than the force Fs of the spring 250 applied to the piston body 210, the valve body 140 receives a force in the negative direction. Thus, the reverse check valve 100 is instantly opened, the pressure Pp of the hydraulic pump 3 is transmitted to the hydraulic cylinder 1 as it is at the same time, and thus the elevator car 2 may be suddenly moved.

On the other hand, the lifting operation of the elevator car 2 when the pilot hydraulic cylinder 200 is provided is represented by Expression 6.

The force F applied to the valve body 140 is represented as follows, by introducing Expression 1.

$$\begin{aligned} F &= -(A1)(Pp)-(A2)(Pj)+(A3)(Pc)-(A4)(Pj)- \\ &\quad (A5)(Pb)+(A6)(Pj)+Fs \\ &= -(A1)(Pj-Pp)+(A6-A4)(Pj)+Fs \end{aligned} \quad \text{[Expression 6]}$$

(here, Pb=0, Pj=Pc, A3=A1+A2, and A6=A4+A5)

When the pilot hydraulic cylinder 200 is provided, the additional force in the positive direction corresponding to '(A6−A4)(Pj)' can be applied to the valve body 140. Thus, the main chamber 120 of the reverse check valve 100 is instantly opened due to a slight pressure difference, thereby overcoming the starting shock phenomenon that the elevator car 2 is suddenly moved at the initial stage of the elevator car lifting command.

In FIG. 4, 't2' indicates a point where the pressure of the second valve chamber 120 of the reverse check valve 100 is equal to that of the first valve chamber 110.

In this point, in case the three way solenoid valve 540 is ON, the pilot pressed oil is supplied from the hydraulic cylinder 1 to the lower chamber 230 of the pilot hydraulic cylinder 200, and thus the pressure Pb of the pressed oil moves the piston body 210 in the negative direction.

Accordingly, the valve body 140 is maintained in the lifting state, and the reverse check valve 100 serves to pass the pressed oil from the hydraulic pump 3 merely to the hydraulic cylinder 1.

Here, when the speed of the motor 4 is increased, as shown in FIG. 5, the pressed oil of the first main oil path 310 is supplied to the hydraulic cylinder 1 along the second main oil path 320 through the reverse check valve 100. As a result, the elevator car 2 is lifted at a speed corresponding to a flow amount of the supplied pressed oil.

In addition, 't3' indicates a point where the elevator car 2 reaches to a designated floor and decelerates.

In this point, in case the three way solenoid valve 540 is OFF, the pilot pressed oil in the lower chamber 230 of the pilot hydraulic cylinder 200 is discharged to the oil tank 8, and thus a pressure thereof is reduced to zero (0), the reverse check valve 100 closes the valve body 140 with the force F as in Expression 6, thereby stably smoothly stopping the car 2 at the finishing point t4.

On the other hand, the lowering operation of the hydraulic elevator system in accordance with the present invention will now be described with reference to FIGS. 6 and 7.

FIG. 6 is a time chart of the control signals outputted from the control unit of the hydraulic elevator system in accordance with the present invention, during the lowering operation, and FIG. 7 is a detailed hydraulic diagram illustrating the hydraulic system in accordance with the present invention, during the lowering operation.

As illustrated in FIG. 6, when the control unit 14 outputs the lowering operation command signal and the speed command signal of the elevator car 2, the motor 4 is operated at the starting point t1 of the lowering operation, and at the same time the pressed oil discharged from the hydraulic pump 3 is supplied to the first valve chamber 110 of the reverse check valve 100.

At this time, the pressure Pb applied to the lower chamber 230 of the pilot hydraulic cylinder 200 is zero (0), and thus an additional pressure is applied to the reverse check valve 100 in the positive direction by the pilot hydraulic cylinder 200, thereby overcoming the starting shock phenomenon resulting from a sudden opening of the reverse check valve 100.

Thereafter, in FIG. 6, at the point t2 where the pressure Pp of the hydraulic pump 3 is equal to the pressure Pc of the third valve chamber 130, the normal open-type solenoid valve 520 is On, namely closed responding to the control signal from the control unit 14, and the solenoid valve 530 is ON, namely opened.

Accordingly, the pilot pressed oil in the third valve chamber 130 of the reverse check valve 100 is discharged to the oil tank 8 through the eighth pilot pressed oil path 480, and thus the pressure Pc in the third valve chamber 130 becomes zero (0). At the same time, the pressed oil in the lower chamber 230 of the pilot hydraulic cylinder 200 is discharged to the oil tank 8 through the three way solenoid valve 540, and thus the pressure Pb also becomes zero (0). As a result, the force F applied to the valve body 140 is represented by Expression 7.

$$F=-(A1)(Pp)-(A2)(Pj)+(A6)(Pj)+Fs \quad \text{[Expression 7]}$$

Here, in case the piston body 210 and the piston rod 240 of the pilot hydraulic cylinder 200 are designed to satisfy '{(A1)(Pp)+(A2)(Pc)}>{(A6)(Pj)+Fs}, the force in the negative direction is applied to the valve body 140, thus forcibly opening the valve body 140.

Therefore, the pressed oil discharged from the hydraulic cylinder by the self weight of the elevator car 2 sequentially passes through the second main oil path 320, the reverse check valve 100 and the first main oil path 310, and is discharged to the oil tank 8 rotating the hydraulic pump 3 in the reverse direction. Here, the motor 4 directly connected to the hydraulic pump 3 is operated as a generator.

At this time, during the lowering operation, the force of '(A6)(Pj)' is applied to the valve body 140 of the reverse check valve 100 by the pilot hydraulic cylinder 200. Accordingly, even if the force Fs of the spring 250 is weak, the time of closing the valve body 140 may be shortened in the emergency stopping of the elevator car 2.

The emergency stopping operation of the elevator car 2 is discussed later in more detail.

In FIG. 6, at the point t3 where the car 2 is lowered due to the self weight and almost reaches into the designated floor, the solenoid valves 520, 530 are OFF, and at the same time the solenoid valve 510 is ON.

Then, the pilot pressed oil is rapidly supplied to the third valve chamber 130 of the reverse check valve 100 through the first and second pilot oil paths 410, 420, the pressure Pc is increased in the close direction of the valve body 140 in the third valve chamber 130 of the reverse check valve 100, and the additional force is applied by the pressure of '(A6)(Pj)' of the upper chamber 220 of the pilot hydraulic cylinder 200, thereby closing the reverse check valve 100.

Accordingly, the elevator car 2 can be stably stopped at the point t4 where it reaches into the designated floor.

Here, the hydraulic elevator system must have a structure of minimizing the pressure loss in order to reduce the energy loss during the lifting or lowering operation.

Therefore, as an opening area of the reverse check valve 100 is increased by the displacement of the valve body 140 thereof, the pressure loss is reduced. In addition, the weaker the force Fs of the spring 250 disposed at the pilot hydraulic cylinder 200 is, the smaller the whole loss is.

However, when an opening area of the reverse check valve 100 is large, a volume of the third valve chamber 130 is increase, thus increasing an open/close operation time of the valve.

Figure 10A:
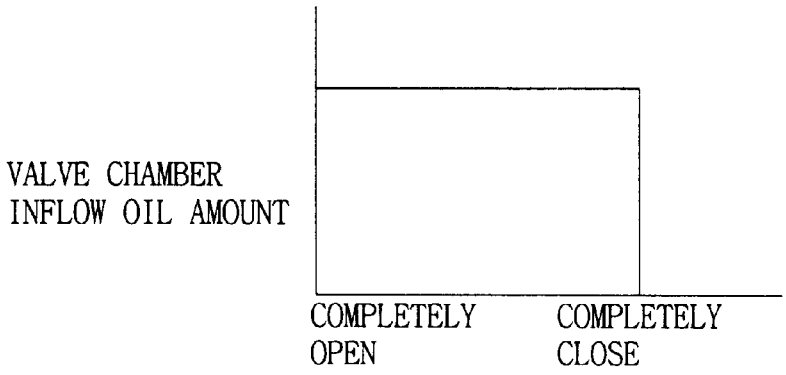
FIG. 10A is a graph showing an oil inflow amount of a reverse check valve chamber of the hydraulic elevator system in accordance with the present invention, during the normal operation.

In this regard, at the deceleration point of the normal lifting or lowering operation, the control unit 14 opens the solenoid valve 520 (OFF), thereby supplying the pilot pressed oil from the first pilot oil path 410 of the pilot circuit 400 through the sixth pilot oil path 460, the middle chamber 225, the third pilot oil path 430 and the fourth pilot oil path 440. As depicted in FIG. 10A, the amount of the oil supplied to the third valve chamber 130 of the reverse check valve 100 is increased, and thus the reverse check valve 100 is well operated, thereby minimizing a stopping shock by the reversed pressed oil at the hydraulic cylinder side around the deceleration of the car 2.

On the other hand, in case the car 2 performs the emergency stopping due to the power failure during the lifting or lower operation, the operation of the hydraulic elevator system will now be explained with reference to FIGS. 8 and 9.

Figure 9:
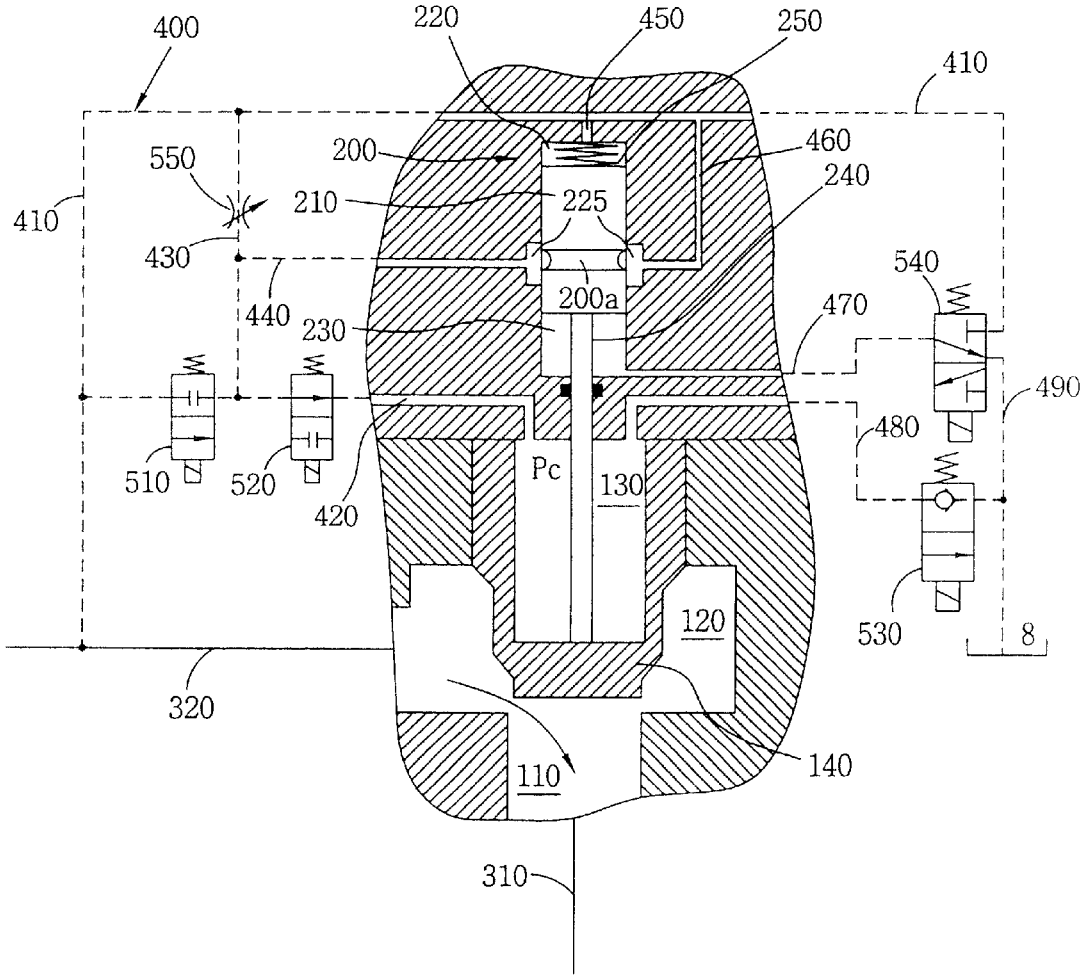
FIG. 9 is a detailed hydraulic circuit diagram illustrating the hydraulic elevator system in accordance with the present invention, during the emergency stopping operation.

FIG. 8 is a time chart of the control signal outputted from the control unit of the hydraulic elevator system in accordance with the present invention, during the emergency stopping operation, and FIG. 9 is a detailed hydraulic diagram illustrating the hydraulic elevator system in accordance with the present invention, during the emergency stopping operation.

According to the present invention, the piston rod 240 of the pilot hydraulic cylinder 200 is always contacted with the valve body 140 of the reverse check valve 100, and thus moved engaged with the movement of the valve body 140. Thus, in a state where the valve body 140 of the reverse check valve 100 is completely opened in the negative direction, when the car 2 performs the emergency stopping due to the power failure, the pressed oil supplied to the third valve chamber 130 of the reverse check valve 100 at an initial stage passes through the first pilot oil path 410 from the hydraulic cylinder 1, and is partially supplied through the sixth pilot oil path 460, the middle chamber 225, the ring-shaped groove 200*a* and the fourth pilot oil path 440, and supplied through the throttle valve 550 and the third pilot oil path 430. The close operation of the valve body 140 of the reverse check valve 100 is rapidly performed, thereby preventing an overspeed of the elevator car 2 resulting from the valve operation delay.

Thereafter, when the valve body 140 of the reverse check valve 100 is moved in the close direction by a predetermined degree, at the same time, the pilot pressed oil is supplied to the upper chamber 220 of the pilot hydraulic cylinder 200.

As a result, the piston rod 240 of the pilot hydraulic cylinder 200 is moved in the positive direction, and thus the middle chamber 225, namely the sixth pilot oil path 440 is blocked.

Figure 10B:
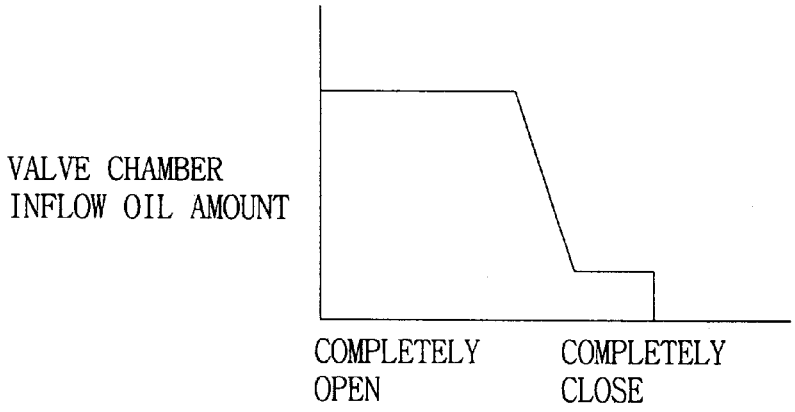
FIG. 10B is a graph showing an oil inflow amount of the reverse check valve chamber of the hydraulic elevator system in accordance with the present invention, during the emergency stopping operation.
Figure 11:
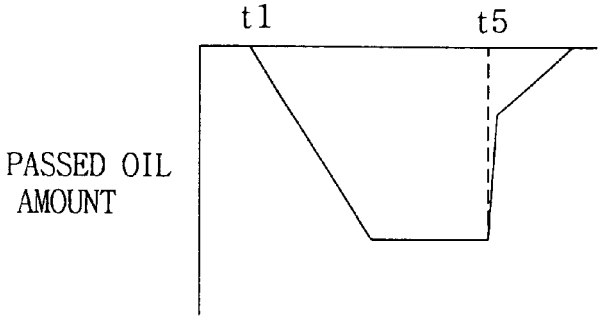
FIG. 11 is a graph showing an oil amount passing through a solenoid valve of the hydraulic elevator system in accordance with the present invention, during the emergency stopping operation.

From this moment, the pilot pressed oil is supplied to the third valve chamber 130 of the reverse check valve 100 merely through the third pilot oil path 430, and a slight amount of the pilot pressed oil flows into the second valve chamber 120 by the throttle valve 550. As illustrated in FIGS. 10B and 11, the valve body 140 of the reverse check valve 100 is slowly closed, and thus the car 2 smoothly stops.

That is to say, the present invention can minimize a stopping shock resulting from a rapid close operation of the valve body 140 when the close time of the reverse check valve 100 is short at the emergency stopping operation, and an instant overspeed of the elevator car 2 resulting from a delay of the initial valve close operation when the close time of the reverse check valve 100 is long.

As discussed earlier, the hydraulic elevator system in accordance with the present invention maximizes energy efficiency by minimizing a pressure loss of the reverse check valve during the lifting/lowering operation of the elevator car, and improves system stability by blocking the reversed pressed oil even when there is a slight pressure difference in the close operation of the reverse check valve, and by stably stopping the elevator car at the designated floor.

In addition, the hydraulic elevator system in accordance with the present invention minimizes the shock of the elevator car resulting from the sudden stop and safely protects the passengers, by properly adjusting the responding speed of the reverse check valve during the emergency stopping by the power failure, etc.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope and defined in the appended claims, and therefore all changes and modifications that fall within the meets and bounds of the claims, or equivalences of such meets and bounds are therefore intended to be embraced by the appended claims.

What is claimed is:

1. A hydraulic elevator system comprising:

an elevator car vertically movable in a hoist way of a building;

a hydraulic cylinder connected to the elevator car for lifting/lowering the elevator car;

a hydraulic pump for supplying pressed oil to the hydraulic cylinder;

a motor for driving the hydraulic pump;

a reverse check valve disposed at a first oil path between the hydraulic cylinder and the hydraulic pump, wherein said reverse check valve is opened to allow pressed oil to be supplied from the hydraulic pump to the hydraulic cylinder when the elevator car is lifted, closed by pilot oil from the hydraulic cylinder to prevent an oil back current from the hydraulic cylinder to the hydraulic pump when the elevator car stops, and opened by pressed oil from the hydraulic pump when the elevator car is lowered, in order to allow the elevator car to be lowered; and a pilot hydraulic cylinder unit disposed at a second oil path in parallel with the first oil path, and between the hydraulic cylinder and the reverse check valve for applying an additional force to the reverse check valve in a closing direction of the reverse check valve by the pilot oil from the hydraulic cylinder.

2. The system according to claim 1, wherein a horizontal cross-section of the pilot hydraulic cylinder unit is smaller than that of the reverse check valve in order to minimize an oil pressure loss during the lifting/lowering operation of the elevator car.

3. The system according to claim 2, wherein the pilot hydraulic cylinder unit comprises:

a piston body movable in opening/closing directions of the reverse check valve by the pilot oil from the hydraulic cylinder;

a piston rod having one end portion engaged with the valve body of the reverse check valve, having the other end portion engaged with the piston body, and transmitting displacement of the piston body in the closing direction of the reverse check valve to the reverse check valve;

a spring abutting to the piston body for biasing the piston body in the closing direction of the reverse check valve; and a cylinder for receiving the spring, the piston rod and the piston body inside, and including:

a first chamber provided with surfaces of the piston body abutting to the spring and inner walls of the cylinder for receiving the pilot oil; and a second chamber consisting of surfaces of the piston body engaged with the piston rod and the inner walls of the cylinder for receiving the pilot oil.

4. The system according to claim 3, wherein the pilot hydraulic cylinder comprises:

a first chamber provided with surfaces of the piston body abutting to the spring and inner walls of the cylinder for receiving the pilot oil;

a second chamber provided with surfaces of the piston body engaged with the piston rod and the inner walls of the cylinder for receiving the pilot oil; and a third chamber for providing a pilot oil supply path to the reverse check vale from the hydraulic cylinder connected to the elevator car by a rapid closing of the reverse check valve at an initial stage of the emergency stopping of the elevator car in a state where the reverse check valve is opened.

5. The system according to claim 3, wherein the piston body comprises a ring-shaped groove for communicating a pilot oil supply path to the reverse check valve from the hydraulic cylinder connected to the elevator car in order to rapidly close the reverse check valve at an initial stage of the emergency stopping of the elevator car when the reverse check valve is opened.

6. The system according to claim 1, wherein the reverse check valve comprises:

a first valve chamber connected with an oil path toward the hydraulic pump;

a second valve chamber connected with an oil path toward the hydraulic cylinder;

a third valve chamber connected to a pilot oil path from the hydraulic cylinder; and a valve body movable to a position of allowing or blocking an opening of the oil path between the first valve chamber and the second valve chamber, and having a stepped portion in order for its outer diameter surface toward the second valve chamber to receive a force in an opening direction by the pressed oil from the hydraulic cylinder.

7. The system according to claim 1, wherein the pilot hydraulic cylinder unit comprises:

a piston body movable in opening/closing directions of the reverse check valve by the pilot oil pressed from the hydraulic cylinder;

a piston rod having one end portion engaged with a valve body of the reverse check valve, having the other end portion engaged with the piston body, and transmitting displacement of the piston body in the closing direction of the reverse check valve to the reverse check valve;

a spring abutting to the piston body for biasing the piston body in the closing direction of the reverse check valve; and a cylinder for receiving the spring, the piston rod and the piston body inside, and including:

a first chamber provided with surfaces of the piston body abutting to the spring and inner walls of the cylinder for receiving the pilot oil; and a second chamber consisting of surfaces of the piston body engaged with the piston rod and the inner walls of the cylinder for receiving the pilot oil.

8. The system according to claim 7, wherein the pilot hydraulic cylinder comprises:

a first chamber provided with surfaces of the piston body abutting to the spring and inner walls of the cylinder for receiving the pilot oil;

a second chamber provided with surfaces of the piston body engaged with the piston rod and the inner walls of the cylinder for receiving the pilot oil; and a third chamber for providing a pilot oil supply path to the reverse check valve from the hydraulic cylinder connected to the elevator car by a rapid closing of the reverse check valve at an initial stage of the emergency stopping of the elevator car in a state where the reverse check valve is opened.

9. The system according to claim 7, wherein the piston body comprises a ring-shaped groove for communicating a pilot oil supply path to the reverse check valve from the hydraulic cylinder connected to the elevator car in order to rapidly close the reverse check valve at an initial stage of the emergency stopping of the elevator car when the reverse check valve is opened.

10. The system according to claim 1, further comprising:

a first solenoid valve disposed at a pilot oil path between the hydraulic cylinder and the reverse check valve, for allowing or blocking a supply of the pressed oil from the hydraulic cylinder to the reverse check valve;

a second solenoid valve disposed at a pilot oil path between the first solenoid valve and the reverse check valve, for allowing or blocking a supply of the pressed oil from the hydraulic cylinder to the reverse check valve;

a throttle valve disposed at a pilot oil path between the hydraulic cylinder and the reverse check valve, for decelerating a closing speed of the reverse check valve during the emergency stopping of the elevator car;

a third solenoid valve disposed at an oil path between the hydraulic cylinder and the pilot hydraulic cylinder unit, for converting a direction of the oil path into a direction of supplying the pilot oil from the hydraulic cylinder to the pilot hydraulic cylinder unit or a direction of discharging the pressed oil from the pilot hydraulic cylinder unit, so that the pilot hydraulic cylinder unit can move to the direction of opening the reverse check valve;

an oil tank for storing the oil;

a fourth solenoid valve disposed at an oil path between the reverse check valve and the oil tank, for opening or closing the oil path;

an oil filter for filtering the oil flowing into or discharged from the oil tank; and a controller for controlling a speed of the motor, and controlling the first to fourth solenoid valves.

* * * * *